US005841675A

United States Patent [19]

Ngo

[11] Patent Number: 5,841,675

[45] Date of Patent: Nov. 24, 1998

[54] METHOD AND APPARATUS FOR MONITORING QUALITY OF ELECTRICAL WIRE CONNECTIONS

[75] Inventor: Kiet Ngo, London, Canada

[73] Assignee: Oes, Inc., London, Canada

[21] Appl. No.: 796,462

[22] Filed: Feb. 10, 1997

[51] Int. Cl.[6] ..... H01R 43/04

[52] U.S. Cl. ..... 364/507; 364/551.01; 364/552; 29/705; 29/715; 29/753; 29/861

[58] Field of Search ..... 364/507, 511, 364/551.01, 552, 554, 474.17, 474.15, 476.01; 72/13.2; 29/701, 861, 862, 863, 592, 596, 753, 700, 729, 745, 747, 748, 720, 705

[56] References Cited

U.S. PATENT DOCUMENTS

| | | | |
|---|---|---|---|
| 4,294,006 | 10/1981 | Blair et al. | 29/701 |
| 4,313,258 | 2/1982 | Kindig et al. | 29/596 |
| 4,400,873 | 8/1983 | Kindig et al. | 29/753 |
| 4,856,186 | 8/1989 | Yoemans | 29/863 |
| 4,914,602 | 4/1990 | Abe et al. | 364/507 |
| 5,055,829 | 10/1991 | Stuttem et al. | 340/677 |
| 5,123,165 | 6/1992 | Strong et al. | 29/861 |
| 5,271,254 | 12/1993 | Gloe et al. | 72/13.2 |

*Primary Examiner*—James P. Trammell
*Assistant Examiner*—Demetra R. Smith
*Attorney, Agent, or Firm*—Howard & Howard

[57] ABSTRACT

An improved method of monitoring the quality of a crimping machine includes setting the boundaries based upon the mean and standard deviation of a number of learned samples. By setting the boundaries based on actual samples, the system is better able to identify whether a particular sample is in fact defective or acceptable. In the prior art, the boundaries have been preset subjectively. By utilizing learned samples, the present invention is able to insure that the particular boundaries are proper given the particular size of wire, the particular type of connector, and particular arrangement of machinery that is being monitored.

16 Claims, 1 Drawing Sheet

METHOD AND APPARATUS FOR MONITORING QUALITY OF ELECTRICAL WIRE CONNECTIONS

BACKGROUND OF THE INVENTION

This application relates to an improved method and apparatus for monitoring the quality of connections made by an electrical wire crimping machine.

In the prior art, crimping machines are utilized to attach electrical connectors to electrical wires. Essentially, a machine deforms or "crimps" a connector member onto an electrical wire. Complicated monitoring systems are utilized to monitor and assure the quality of each crimp. In general, the force experienced by the crimping machine when crimping the connector to the wire is captured and studied to determine whether the crimp would appear to be acceptable. As one example, if there are too few wire strands in the wire, than the force of the particular crimp would differ from that which is expected. If the force differs from the expected force by more than a predetermined amount then a determination is made that the particular connection is defective. In general, the prior art has looked at the entire force curve and compared it to desired force curves. If the actual force curve differs from the desired force curve by a predetermined amount, then the determination is made that the particular connection is defective.

In a second type of known monitoring, the system develops characteristics of the force curve and compares those characteristics to expected characteristics. In one successful system, the monitoring system captures the peak of the force curve, the area beneath the force curve, and also a "peak factor". The peak factor is the area divided by the peak. By comparing these three characteristics to desired characteristics, a determination can be made whether a particular crimp is acceptable. If the particular force characteristics of a connection extend outside of preset boundaries then the determination is made that the connection is defective.

The prior art has set both outer and inner boundaries as a preset percentage of the mean of each characteristic. An operator is provided with the ability to adjust the preselected percentage. The outer boundaries are utilized to identify a "gross" or drastic problem with the system. When the force characteristic crosses the outer boundary, it is likely that there has been a jam or other misalignment within the crimping tool. Thus, a determination that a force characteristic has crossed this boundary may be associated with a shut down of the machine. An inner or "fuzzy" boundary is set to identify a connection which is proper. If a force characteristic of a particular connection crosses this boundary then the determination is made the particular connection is likely defective for some reason. However, it may not be necessary that the system be shut down when this inner or "fuzzy" boundary is crossed.

There are some deficiencies with this prior art system. One main problem, is that the boundaries are preset and subjective. They are not based on the variables for the particular machine. While this system is often still acceptable, it would be desirable to have the boundaries be associated more closely with the type wire or connection being performed, and also the particular machine that is being utilized. As an example, with different size wires or different type of connectors, the necessary boundaries to achieve an acceptable connection may change. With the prior art preset method it has been difficult to adjust the boundaries as necessary for the particular wire, connector, machinery system, etc. In addition, a particular crimping machine may be associated with other machinery in such a way that the forces or other stresses and strains on the system may vary the force curve. Thus, to some extent, each machine has individual acceptable boundaries.

With this type of system it is likely that the boundaries are often not set at optimum levels. If the boundaries are too "tight," then there is an unnecessary high percentage of scrap. This is, of course, undesirable. On the other hand, if the boundaries are set too "loose," then there may be defective connections which are not identified. This is also undesirable.

For the reasons set forth above the prior art method of presetting the boundaries is somewhat deficient.

SUMMARY OF THE INVENTION

In the disclosed embodiment of this invention, the boundaries for the peak, area and peak factor characteristics of a crimp monitoring tool are set based on learned samples for the particular machine, wire and connector. In one disclosed embodiment, a number of samples are ran with the monitor in a learning mode. The monitor captures the peak, area and peak factor for those samples. If any of the samples differ markedly from the other samples, then at least the particular different sample is not utilized. In one example, if any of the three characteristics differ by more than 2% from the prior sample then the system begins again to try and run consecutive samples that are each within 2% of each other. Once the system has ran a set number of samples (in one example 5) that are within the tolerance range, than the outer or "gross" boundaries are set based upon the sample characteristics.

In particular, the system sets the boundaries by determining the standard deviation for each of the characteristics and then spaces the boundaries from the mean by the standard deviation times a factor. In one example, the system utilizes five times the standard deviation to set the outer boundaries away from the mean for each of the three characteristics.

A number of other learn samples are then ran (in one example 64). Once this greater number of samples have been ran, the system again determines the mean and the standard deviation for each of the characteristics. The inner or "fuzzy" boundaries are also set. In one example, the fuzzy characteristics are set to be three standard deviations away from the mean. Once these boundaries are set, the system can proceed with routine or production crimping of connectors to the wires. If a particular part exceeds the gross limit, then the system preferably shuts the machine down such than an operator can determine why the outer limit has been exceeded. On the other hand, if the inner or "fuzzy" limit is exceeded then an indication is made that the particular connection should be discarded, or at least studied to determine whether it is acceptable.

Once the system begins to run production parts (i.e., after the fuzzy boundaries have been set) the mean is continuously recalculated. In one example, every five consecutive acceptable parts are utilized to recalculate the mean. This is desirable as conditions for the system will change as the machine runs. As an example, as the machine runs, the temperature of the machine will change. This will change the resulting force characteristics. By continuously recalculating the mean, the present invention is sure to accommodate those changes. The original preset inner and outer boundaries are preferably not recalculated.

In addition, in the event the machine is shut down for a predetermined period of time, the temperature change could cause slight variations to the process that could result in unnecessary scrap. For this reason, the monitor is preferably provided with a timer which can sense an idle time for the machine. In the event the idle time exceeds the predetermined time period, then the fuzzy limits are turned off. The fuzzy limits are then recalculated by taking a new set of samples once the machine is restarted. Those new samples are then utilized to recalculate the mean, and the standard deviation to reset the fuzzy limits and the outer limits.

The present invention also preferably displays the CPK for the system each time the fuzzy limits are recalculated. In the present invention, the CPK is calculated by selecting a small amount of force (in one example 50 pounds) and dividing that amount by three times the standard deviation. In this way, a relative value of the CPK for each relearned set of fuzzy limits is displayed to the operator.

In other features of this invention, it is preferred that when the first initial samples are ran to set the outer limits, an operator be given the opportunity to study those samples. In initially setting the outer limits, there are not yet any inner or "fuzzy" limits. Thus, the operator may wish to study those initial samples to determine whether any of the parts are defective. If so, the operator may wish to rerun the samples to eliminate any influence from an improper part that would still be within the outer or "gross" limits.

An improved monitoring system and a method of utilizing the system is disclosed. The improved invention allows a system to be quickly set up to change the type of wire, connector, or machinery associated with the tool which is utilized. The invention also eliminates scrap and down time by insuring that any part which is indicated as being defective is in fact defective for the particular type of part being ran.

By utilizing the standard deviation, the system ties the boundaries directly to the type of deviation experienced for the particular arrangement of wire, connector and machinery. The use of the standard deviation allows one to preset objectively what is thought of as a defective part. In the absence of such an objective characteristic the operator is left to subjectively determine boundaries. The invention is particularly valuable in addressing individual characteristics of the particular connection and particular tooling.

These and other features can be best understood from the following specification and drawings, of which the following is a brief description.

DETAILED DESCRIPTION OF PREFERRED EMBODIMENT

Figure 1:
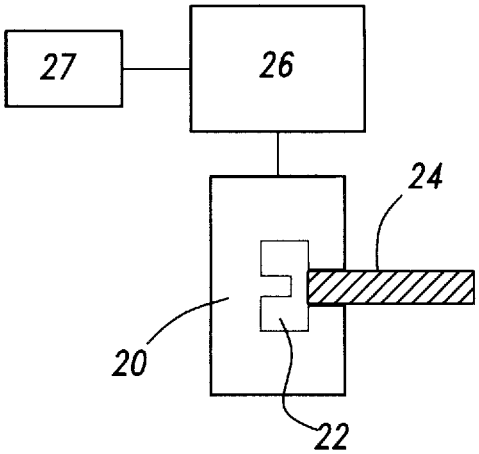
FIG. 1 is a schematic view of a tool according to the present invention.

FIG. 1 shows a crimping tool 20 for crimping a connector 22 onto a wire 24. A monitoring system 26 monitors the force experienced by tool 20 when crimping connector 22 onto wire 24. It should be understood that FIG. 1 is very schematic and is only utilized to describe the broad outlines of the system.

Figure 2:
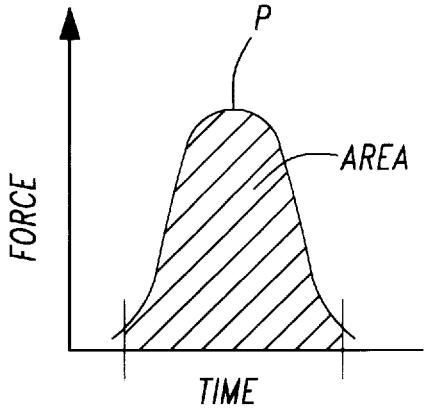
FIG. 2 shows a force curve for a crimping machine.

As shown in FIG. 2, force curve 28 can be set for each of the cycles of connecting a connector 22 to a wire 24. By plotting the load versus time for each connection, a curve 28 is generated.

A load sensor, which may be a piezo-electric type sensor, is placed adjacent machine 20 and monitors the force. Known components digitize the signal from the sensor such that monitoring system 26 determines the peak P of the force curve 28 and the area of the force curve 28. That is, the area beneath the force curve between two preset points in time. Once area and peak are determined, the peak factor can be determined by dividing the area by the peak. Monitoring system 26 preferably includes a CPU with the necessary software to achieve the described functions. On the other hand, other types of controls could be used and would still be within the scope of this invention.

The invention will be explained with reference to the flow chart shown in FIG. 3. Again, it should be understood that the monitoring system 26 includes the appropriate software, controls, or other elements necessary to achieve the method steps set forth with reference to FIG. 3.

Figure 3:
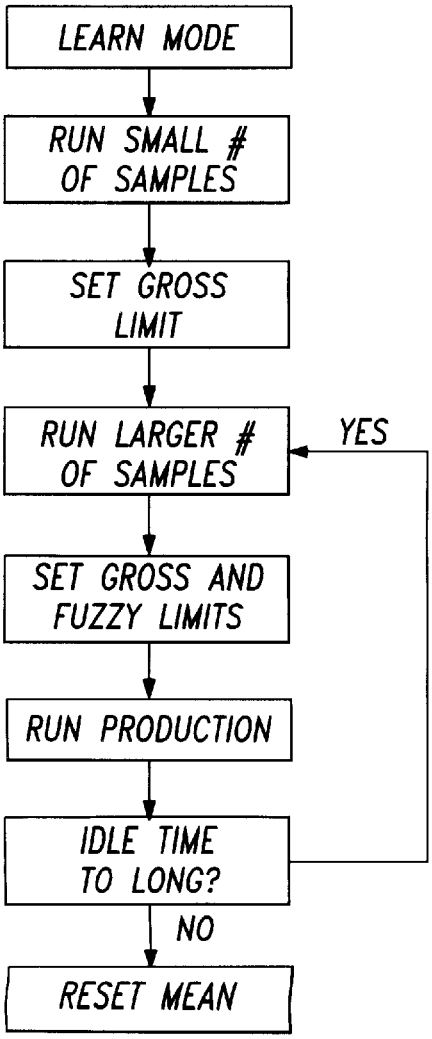
FIG. 3 is a flow chart of the inventive method.

As shown in FIG. 3, when a new system is set up, the crimp height, the size of the connector, the number of wire strands in a wire, or even the arrangement of a particular tool and its associated machinery may be different from any other system. Thus, the present invention initially moves the monitoring system 26 into a learning mode. An appropriate control is preferably actuated to move monitoring system 26 into a learn mode. In the learn mode a predetermined number of consecutive samples are made by the tool 20. In one example, five samples are ran. The control determines the peak, area and peak factor for each of those samples. If all of the samples fall within a predetermined percentage range (i.e., 2%) then those five samples are found acceptable. If the samples extend out of the 2% range then the system begins again to attempt to run five consecutive samples within the range. At some point, the system may indicate an error if it is unable to achieve sufficient consecutive acceptable samples.

Once consecutive samples within the range have been captured, the monitoring system next determines the mean and the standard deviation within the five samples for peak, area and peak factor. The monitoring system then sets outer or primary control limits based on the standard deviation. In one example, the boundaries are set to be five standard deviations away from the mean. These outer boundaries are utilized to determine a gross or serious problem.

The control then moves into the second portion of the learn phase, where additional samples are taken. Once a particular number of samples which fall within the outer or primary control limits occur, (i.e., 64 samples) the control then recomputes the mean and the standard deviation. The outer or primary control limits are recomputed, again based on five times the standard deviation. A second set of tolerances or boundaries called the "fuzzy" or inner control limits are set at three times the standard deviation. At this point, the system has established both its inner and outer boundaries. Since the boundaries are based on statistical information from actual samples, the boundaries are not subjective, but instead are objective. Moreover, since the boundaries are based on standard deviation, they provide a very real feedback on how close the particular run part is to the average part, and also how close the particular part is to the average difference from a typical part compared to the mean. In this way, the system optimally sets the tolerances. This then minimizes scrap and process down time.

Preferably, as production runs occur, the mean is continuously recalculated based upon a preset number of prior acceptable parts. In one example, the five previous parts are utilized to continuously recalculate the mean. The standard deviation and the boundaries are not reset with this recalculation of the mean. This recalculation of the mean ensures that changes within the system, which may occur as the temperature of the system changes, are accommodated.

In other features of this invention, the monitor system 26 has a timer 27 which monitors whether it has a significant amount of down time. After a significant amount of down time there may be variation within the system. If the timer determines that a significant amount of down time has occurred, the system may move into reestablishing its boundaries. As an example, in such an event the system may eliminate the inner control boundaries and recalculate those boundaries based on the first 64 samples after start up. In one example, the predetermined period of time is 30 minutes.

By resetting the boundaries after this particular amount of down time, the monitoring system again is sure to provide real feedback on the particular characteristics at the time of the operation of the system. Such recalculation may not have been necessary with the prior art subjectively selected boundaries. However, it is desirable with the instant invention which bases the boundaries on the characteristics of the system.

The system may be easily tailored to particular conditions. As one example, following the initial setting of the outer or primary control limits, the system may provide the operator the opportunity to check the learn samples. If one sample is not acceptable, it may still be within a particular range (i.e, 2%) of the other parts, and yet it would be more desirable to set the boundaries without that defective part. If the operator determines that one of the samples is defective, then it may be desirable to rerun those initial samples.

In addition, the control can be tailored for the number of defective parts that may be identified to result in shut down of the system. As an example, it may be desirable that one primary failure will lead to shut down of the system. On the other hand, it may be desirable to only shut down the system based on a greater number of consecutive inner or fuzzy boundary crossings.

A preferred embodiment of this invention has been disclosed, however, a worker of ordinary skill in the art would recognize that certain modifications would come within the scope of this invention. For that reason, the following claims should be studied to determine the true scope and content of this invention.

I claim:

1. A control for an electric wire crimp machine comprising:

a input operatively connected to a crimping machine and operable to receive information on the force during each cycle at the crimping machine;

said control be operable to move into a leaning mode and capture information on a predetermine number of sample force curves from the crimping machine, said control being operable to preset boundaries based upon said information;

said control also being operable to monitor subsequent crimping cycles and compare the particular information from each cycle with said boundaries to determine whether the particular force characteristics cross said boundaries; and said control being operable to capture a force curve from the machine, and determine a peak and an area for each of said force curves, and said boundaries are set for at least each of said peak and said area based on a particular number of samples, said control presets outer and inner boundaries said control being operable to provide signals when a particular cycle crosses either said inner or said outer boundaries, said inner and outer boundaries are preset by determining both the mean and standard deviations for at least peak and area for said force curves, and setting said inner and outer boundaries a predetermined number of sample deviations away from said mean.

2. An apparatus as recited in claim 1, wherein at least said mean is continuously recalculated during production operation of the crimping machine, and after the initial setting of said inner and outer boundaries.

3. An apparatus as recited in claim 2, where only said mean is recalculated, and said boundaries are not recalculated.

4. A control for an electric wire crimp machine comprising:

a input operatively connected to a crimping machine and operable to receive information on the force during each cycle at the crimping machine;

said control be operable to move into a learning mode and capture information on a predetermine number of sample force curves from the crimping machine, said control being operable to preset boundaries based upon said information;

said control also being operable to monitor subsequent crimping cycles and compare the particular information from each cycle with said boundaries to determine whether the particular force characteristics cross said boundaries:

said control is operable to capture a force curve from the machine, and determine a peak and an area for each of said force curves, and said boundaries are set for at least each of said peak and said area based on a particular number of samples, said control presets outer and inner boundaries, said control is operable to provide signals when a particular cycle crosses either said inner or said outer boundaries said control includes a timer, said timer monitoring when the crimping machine has been shut down for a predetermined idle time, and said control shutting off at least said inner boundaries when said predetermined time has been exceeded, said control then moving back into a learning mode and capturing information on a second set of sample force curves for the crimping machine to reset at least said inner boundaries from said second set of force curves.

5. A method of monitoring a crimping machine comprising the steps of:

1) providing a monitor associated with a crimping machine, said monitor being operable to receive information on a force versus time curve from said crimping machine on each of said crimping machine cycles and determine a mean and standard deviation for said curves;

2) running said crimping machine, and receiving a particular number of cycles of force curve information, and utilizing said cycles to set boundaries based upon determination of a mean and standard deviation for said force curves;

3) monitoring subsequent cycles of said crimp machine by comparing the force curve of said subsequent cycles to said boundaries; and 4) said control presents both inner and outer limits, with said outer limits being spaced further from said mean than from said inner limits.

6. A method as set forth in claim 5, wherein said outer limits are spaced from said mean by five times the standard deviation and said inner limits are spaced from the mean by three times the standard deviation.

7. A method as set forth in claim 6, wherein said characteristics include determination of the peak force from said curve, the area beneath said force curve between two particular time periods, and a peak factor determined by dividing said area and said peak, each of said peak, area and peak factor being compared to inner and outer boundaries.

8. A method as set forth in claim 5, wherein said monitor is provided with a timer, said timer monitoring any idle time from said crimping machine wherein no new cycles are ran, and said timer including a predetermined shut down idle time, said timer turning off said boundary limits if said predetermined idle time is exceeded.

9. A method as set forth in claim 8, wherein said monitor presets both inner and outer boundary limits, and only said inner limits are reset upon said idle time being exceeded.

10. A method as set forth in claim 8, wherein said mean is continuously being recalculated during operation, but said standard deviation is not recalculated.

11. A method as set forth in claim 5 comprising the steps of determining initial boundaries by running a first small number of samples and determining outer boundaries, said samples being compared to each other, and only accepted if a particular number of consecutive samples all fall within a particular percentage of each other.

12. A method as set forth in claim 11, wherein said method further includes the steps of determining said boundaries by running a second higher number of samples after running said first small number of samples, determining a new mean and a new standard deviation once said second number of samples is complete, and then resetting inner and outer boundaries based on said new mean and standard deviation.

13. A method of monitoring the quality of connections from a crimping machine comprising the steps of:

1) providing a crimping machine, and a monitor associated with said crimping machine, said monitor being operable to receive information on the force said crimping machine experiences over time on each of the cycles of said crimping machine, said monitor further being operable to determine the peak for each of said force curves, the area under each of said force curves between two predetermined periods of time, said monitor also being operable to determine a mean and standard deviation for at least one of said peak and area from said force information, and said monitor also being operable to utilize a predetermined number of said cycle information to establish boundaries based upon said determined mean and standard deviation;

2) running said crimping machine to make a predetermined number of cycles;

3) capturing information on said predetermined number of cycles, and determining a mean and standard deviation for said predetermined number of cycles for at least one of said peak or area and setting boundaries based upon said determined mean and standard deviation; and 4) running subsequent cycles of said crimping machine and comparing force information from said subsequent cycles to said boundaries, and identifying a fault connection if said information crosses said boundaries.

14. A method as recited in claim 13, wherein said monitor determines a peak factor variable based upon said peak and said area, said peak factor also being compared to boundaries which said monitor sets based upon a determined mean and standard deviation for said peak factor.

15. A method as recited in claim 13, wherein said monitor continually recalculates at least said mean on production cycles.

16. A method as recited in claim 13, wherein said monitor is provided with a timer, said timer including a predetermined idle time, and said monitor shutting off at least some of said boundaries if said crimping machine does not run a cycle within said predetermined idle time, said monitor then recalculating said boundaries once said crimp machine begins to run subsequent cycles.

* * * * *